US005920251A

United States Patent [19]

Shea

[11] Patent Number: 5,920,251

[45] Date of Patent: Jul. 6, 1999

[54] REUSABLE FUSE USING CURRENT LIMITING POLYMER

[75] Inventor: John Joseph Shea, Pittsburgh, Pa.

[73] Assignee: Eaton Corporation, Cleveland, Ohio

[21] Appl. No.: 08/820,326

[22] Filed: Mar. 12, 1997

[51] Int. Cl.[6] ..... H01H 61/06; H01H 37/02; H01H 37/32; H01H 61/00

[52] U.S. Cl. ..... 337/140; 337/123; 337/111; 337/35; 338/22 R

[58] Field of Search ..... 337/140, 167, 337/159, 158, 186, 195, 194, 273, 282, 335, 377, 333, 334, 380, 102–104, 100, 107; 338/23, 20, 204, 205, 22 R; 219/504

[56] References Cited

U.S. PATENT DOCUMENTS

| | | | |
|---|---|---|---|
| 2,294,767 | 9/1942 | Williams | 200/120 |
| 4,238,812 | 12/1980 | Middleman et al. | 361/106 |
| 4,272,471 | 6/1981 | Walker | 264/104 |
| 4,304,987 | 12/1981 | van Konynenburg | 219/553 |
| 4,306,211 | 12/1981 | Hofsass | 337/89 |
| 4,314,231 | 2/1982 | Walty | 338/328 |
| 4,352,083 | 9/1982 | Middleman et al. | 338/23 |
| 4,426,633 | 1/1984 | Taylor | 338/25 |
| 4,545,926 | 10/1985 | Fouts, Jr. et al. | 252/511 |
| 4,689,475 | 8/1987 | Kleiner et al. | 219/553 |
| 4,774,024 | 9/1988 | Deep et al. | 252/511 |
| 4,775,778 | 10/1988 | van Konynenburg et al. | 219/549 |
| 4,800,253 | 1/1989 | Kleiner et al. | 219/553 |
| 4,845,838 | 7/1989 | Jacobs et al. | 29/671 |
| 4,910,389 | 3/1990 | Sherman et al. | 219/548 |
| 4,924,074 | 5/1990 | Fang et al. | 219/548 |
| 5,049,850 | 9/1991 | Evans | 338/22 R |
| 5,195,013 | 3/1993 | Jacobs et al. | 361/106 |

OTHER PUBLICATIONS

Shea, et al., *Blow–Open Forces on Double–Break Contacts*, IEEE Transactions on Components, Packaging, and Manufacturing Technology, vol. 17, No. 1, Mar. 1994.

*Primary Examiner*—Leo P. Picard
*Assistant Examiner*—Anatoly Vortman
*Attorney, Agent, or Firm*—Martin J. Moran

[57] ABSTRACT

Low voltage current limiting fuses wherein the conventional fusible element is replaced. The fuses of the invention are resettable manually or automatically such that the fuse need not be physically replaced following a fault current or overload current occurrence in the external circuit in which the fuse is incorporated. The fuses of the invention generally comprise resettable low voltage current limiting fuses that automatically reset themselves following removal of a fault condition comprising: a casing having an interior cavity and a first and a second electrically conductive terminals; a current limiting polymer element disposed within the interior cavity of the casing and in electrical contact with said first electrically conductive terminal; a bullet conductor having a moving contact slidably disposed within the interior cavity; a conductor electrically connecting the current limiting polymer element to the bullet conductor; a stationary contact within the interior cavity and in electrical contact with the second electrically conductive terminal; and, a means for biassing the moving contact to engage the stationary contact under normal steady-state current conditions.

30 Claims, 4 Drawing Sheets

REUSABLE FUSE USING CURRENT LIMITING POLYMER

BACKGROUND OF THE INVENTION

1. Field of the Invention

The invention relates to the field of low voltage power fuses, and in particular concerns a resettable, low voltage current limiting fuse using a current limiting polymer.

2. Prior Art

Interruption of a low voltage circuit advantageously requires a current interruption device that rapidly brings the current flowing through the circuit to zero upon the occurrence of a line fault. A "low" voltage fuse as generally considered herein is of a type employed in power distribution circuits operating up to 600 $V_{rms}$. Line faults at these energy levels can cause extensive damage to the circuit components and devices connected to the circuit. To minimize potential damage, fuses are employed with the intent to interrupt current flow quickly, following the onset of fault conditions such as a short circuit.

A typical low voltage current limiting fuse includes: a hollow tubular casing of an electrically insulating material, such as a tubular glass reinforced epoxy casing; a pair of electrical end terminals, such as contact ferrules, closing opposite ends of the tubular casing; at least one fusible element, including reduced cross-sectional arcing regions along its length, electrically coupled between the end terminals, such as silver ribbon or wire.

When the low voltage fuse is subjected to an applied current that exceeds the rated current-carrying capability of the fusible element for a predetermined duration, resistive heating raises the temperature of the fusible element sufficiently to melt it. Tin ("M-effect" material) can be disposed at one or more longitudinally restricted regions along each fusible silver conductor to define relatively lower melting temperature region(s), whereby gaps open at these regions when the fusible element melts.

An electric arc is struck across the gap formed when melting breaks the solid metal conductive path between the terminals. Therefore, one of a plurality of series-connected arcs are formed in the fuse, each having a given resistance. Current through the fuse is interrupted when the sum of the voltages across the individual arcs exceeds the voltage applied to the fuse, stopping the flow of current.

Thus, the current limiting effect is obtained initially by introducing arc resistance in series with the circuit. Over a preferably-short period of time, the arcs that are formed in the gaps of the fusible elements are extinguished as the gaps enlarge. Resistive heating is proportional to the square of the current and will melt the fusible element if the heating exceeds the capacity of the fuse to dissipate heat during a long enough time.

Once the fusible element melts, cutting off the flow of current through the fuse, the fuse must be replaced. This phenomena is particularly problematic on military ships. The replacement of such fuses following electrical faults occurring during battle operations on such vessels can place the ship and its crew at risk. During such an operation it may prove difficult to quickly locate the blown fuse in order to replace it. Furthermore, locating and installing an appropriate replacement fuse may cause critical systems to remain inoperative for an unacceptable period of time.

What is needed is a low voltage current limiting fuse which is resettable or which automatically resets allowing the electrical systems being protected by the fuse to be returned to operation quickly following the occurrence of a fault current.

The present invention provides a resettable low voltage current limiting fuse which can interrupt a fault current and thereafter be reset. Specifically, the invention provides both manually resetting and automatically resetting low voltage current limiting fuse designs.

SUMMARY OF THE INVENTION

It is an object of the invention to provide a resettable low voltage current limiting fuse which operates to interrupt the flow of current through a circuit in the event of a fault current or overload current condition.

It is a further object of the invention to provide a resettable low voltage current limiting fuse which incorporates a current limiting polymer element.

It is another object of the invention to provide a shunt connected in parallel with the current limiting polymer element and designed to prevent overvoltage on the current limiting polymer element during switching.

It is another object of the invention to provide a resettable low voltage current limiting fuse that automatically resets itself following removal of a fault current or overload current condition.

It is another object of the invention to provide a resettable low voltage current limiting fuse that automatically resets itself with a delay following removal of a fault current or overload current condition.

It is still another object of the invention to provide a resettable low voltage current limiting fuse that can be manually reset following the removal of a fault current or overload current condition.

It is another object of the invention to provide a resettable low voltage current limiting fuse which incorporates a solenoid to facilitate quick opening of the fuse under fault conditions.

In one embodiment, the invention resides in a resettable low voltage current limiting fuse that automatically resets itself following removal of a fault condition comprising: a casing having an interior cavity and a first and a second electrically conductive terminals; a current limiting polymer element disposed within the interior cavity of the casing and in electrical contact with said first electrically conductive terminal; a bullet conductor having a moving contact slidably disposed within the interior cavity; a conductor electrically connecting the current limiting polymer element to the bullet conductor; a stationary contact within the interior cavity and in electrical contact with the second electrically conductive terminal; and, a means for biassing the moving contact to engage the stationary contact under normal steady-state current conditions.

In another embodiment, the invention resides in a resettable low voltage current limiting fuse that automatically resets itself with a delay following removal of a fault condition comprising: a casing having an interior cavity and a first and a second electrically conductive terminals; a current limiting polymer element disposed within the interior cavity of the casing and in electrical contact with said first electrically conductive terminal; a bullet conductor having a moving contact slidably disposed within the interior cavity; a conductor electrically connecting the current limiting polymer element to the bullet conductor; a means for delaying the resetting of the fuse following a fault condition; a stationary contact within the interior cavity and in electrical contact with the second electrically conductive terminal; and, a means for biassing the moving contact to engage the stationary contact under normal steady-state current conditions.

In another embodiment, the invention resides in a resettable low voltage current limiting fuse that must be manually reset following removal of a fault condition comprising: a casing having an interior cavity and a first and a second electrically conductive terminals; a current limiting polymer element disposed within the interior cavity of the casing and in electrical contact with said first electrically conductive terminal; a bullet conductor having a moving contact slidably disposed within the interior cavity; a conductor electrically connecting the current limiting polymer element to the bullet conductor; a stationary contact within the interior cavity and in electrical contact with the second electrically conductive terminal; a means for biassing the moving contact to engage the stationary contact under normal steady-state current conditions; and, a means for preventing the fuse from automatically reclosing following the opening of the fuse by a fault current or overcurrent occurrence.

Yet another embodiment of the invention resides in a quick opening resettable low voltage current limiting fuse comprising: a casing having an interior cavity and a first and a second electrically conductive terminals; a current limiting polymer element disposed within the interior cavity of the casing and in electrical contact with said first electrically conductive terminal; a bullet conductor having a moving contact slidably disposed within the interior cavity; a conductor electrically connecting the solenoid to the bullet conductor; a plunger having an electrically insulating end and a steel end with the insulating end connected to the bullet conductor with the steel end spaced apart from the bullet conductor; a solenoid disposed within the interior cavity and in electrical contact with the current limiting polymer element; the steel end of the plunger disposed within the coil axis of the solenoid; a stationary contact within the interior cavity and in electrical contact with the second electrically conductive terminal; and, a means for biassing the moving contact to engage the stationary contact under normal steady-state current conditions.

In still another embodiment, the invention resides in a resettable low voltage current limiting fuse that automatically resets itself following removal of a fault condition comprising: a casing having an interior cavity and a first and a second electrically conductive terminals; a current limiting polymer element disposed within the interior cavity of the casing and in electrical contact with said first electrically conductive terminal; a stationary contact within the interior cavity and in electrical contact with the current limiting polymer element; a bullet conductor having a moving contact slidably disposed within the interior cavity; an optional conductor electrically connecting the bullet conductor to the second electrically conductive terminal; and a means for biassing the moving contact to engage the stationary contact under normal steady-state current conditions.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

The invention provides an improved low voltage current limiting fuse which allows for the reinstatement of normal current following a momentary fault current or overload current occurrence without the need to replace the fuse. Specifically, the low voltage current limiting fuses of the invention open when a fault current or overload current occurs and automatically reclose, or are reclosable, once the fault current or overload current is cleared.

The following detailed description represents the best presently contemplated mode of carrying out the invention. The description is not intended in a limiting sense, and it is made solely for the purpose of illustrating the general principle of the invention. The various features and advantages of the present invention may be more readily understood with reference to the following detailed description taken in conjunction with the accompanying drawings and claims. While the discussion below refers to a fuse with a generally cylindrical geometry, it will be understood by those skilled in the art that other geometries may also be utilized.

Figure 1:
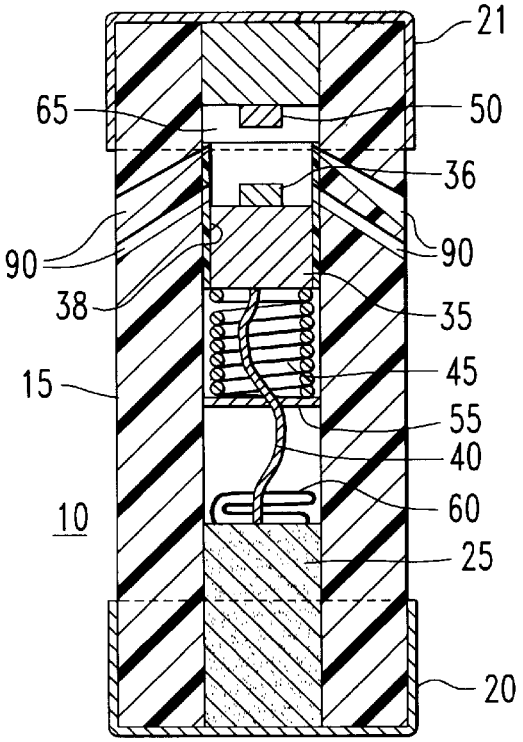
FIG. 1 is a cross sectional view of one embodiment of the resettable resettable low voltage current limiting fuse of the invention that automatically resets itself following removal of a fault condition.

FIG. 1 shows a diagrammatic view of a resettable low voltage current limiting fuse 10 in an open position comprising: a casing 15 with an interior cavity and a first and a second electrically conductive terminals or Ferrules 20, 21; a current limiting polymer element 25 disposed within the interior cavity and in electrical contact with said first electrically conductive terminal 20; a bullet conductor 35 having a moving contact 36 slidably disposed within the interior cavity; a conductor 40 electrically connecting the current limiting polymer element 25 to the bullet conductor 35; a stationary contact 50 within the interior cavity and in electrical contact with second electrically conductive terminal 21; and, a means for biassing the moving contact to engage the stationary contact closing the fuse under normal steady-state current conditions.

Figure 2:
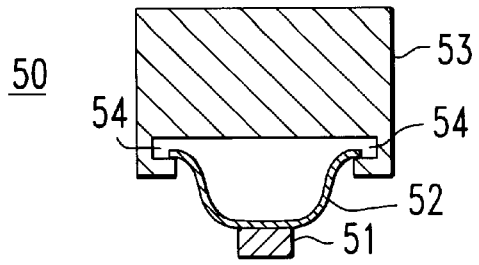
FIG. 2 is a cross sectional view of a preferred stationary contact.
Figure 3:
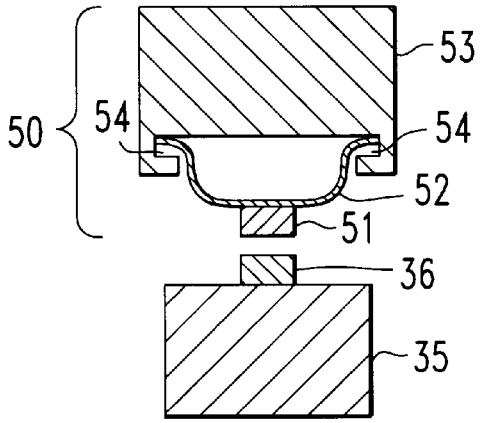
FIG. 3 is a diagrammatic view of a preferred stationary contact wherein the snap disk is in the open position.
Figure 4:
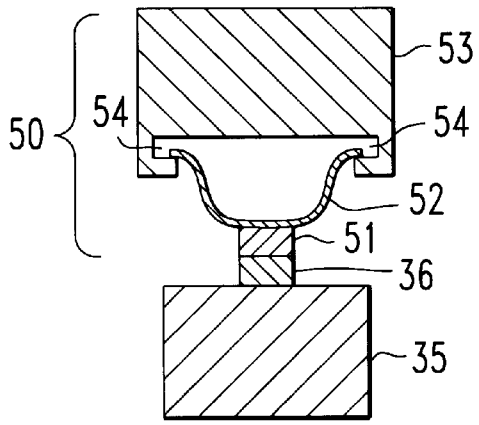
FIG. 4 is a diagrammatic view of a preferred stationary contact wherein the snap disk is in the closed position.

FIG. 2 shows a cross sectional view of a preferred stationary contact 50 comprising an electrical contact 51 attached to a bimetallic snap disk 52 which is in contact with a copper backing 53. The snap disk is retained on the copper backing by fitting the disk in groove 54. With the preferred stationary contact arrangement, current overloads above the device rating but below the level required to cause the device to blow open will cause the snap disk to open the contacts and break the circuit. FIG. 3 shows a diagrammatic view of preferred stationary contact 50 wherein snap disk 52 is in the open position. The contacts will automatically reclose when the bimetallic disk cools down. FIG. 4 shows a diagrammatic view of preferred stationary contact 50 wherein snap disk 52 is in the closed position with contact 51 in physical and electrical contact with moving contact 36.

Casing 15 is preferably of tubular geometry, and most preferably is shaped such that fuse 10 can function as a direct replacement for existing fuses rated for 600 $V_{ac}$. Casing 15 is preferably constructed of an electrically insulating material, for example glass reinforced epoxy resin.

The electrically conductive terminals or ferrules 20, 21, for example plated copper ferrules, are attached in a suitable manner to casing 15. The terminals 20, 21 provide a means for electrically connecting fuse 10 to an external circuit (not shown) to be protected from overcurrent conditions.

Conductor 40 provides an electrical coupling of current limiting polymer element 25 and bullet conductor 35. Conductor 40 preferably comprises a flexible wire or braid, or a multiplicity of wires or braids electrically coupling bullet conductor 35 to current limiting polymer element 25.

Current limiting polymer element 25 comprises a polymer composition, which exhibits positive temperature coefficient of resistance (PTC) behavior, and electrical contacts or electrodes attached thereto in known fashion. Such polymer compositions are known and have been widely used in electrical devices. The current limiting PTC polymer compositions generally include conductive particles, such as carbon black, graphite or metal particles, dispersed in a polymer matrix, such as thermoplastic polymer, elastomeric polymer or thermosetting polymer. PTC behavior in a current limiting polymer composition is characterized by the material undergoing a sharp increase in resistivity as its temperature rises above a particular value otherwise known as the anomaly or switching temperature, $T_s$. Particularly, when the current passing through the current limiting polymer composition exceeds a certain maximum value for a given composition, the composition undergoes resistive heating. If the current remains high enough, long enough, the composition will heat to its transition temperature or switching temperature, $T_s$, at which temperature the composition will exhibit a rapid increase in its resistance, transforming it to a high resistance state.

Representative current limiting polymer compositions are described in U.S. Pat. Nos. 4,238,812 (Middleman et al.); 4,304,987 (van Konynenburg); 4,545,926 (Fouts, Jr. et al.); 4,774,024 (Deep et al.); 4,775,778 (van Konynenburg et al.); 4,845,838 (Jacobs et al.); 4,910,389 (Sherman et al.); 5,049,850 (Evans); and, 5,195,013 (Jacobs et al.). The disclosure of each of these U.S. Patents is hereby incorporated herein by reference.

Representative methods for connecting electrodes to current limiting polymer compositions are described in U.S. Pat. Nos. 3,351,882 (Kohler et al.); 4,272,471 (Walker); 4,314,231 (Walty); 4,426,633 (Taylor); 4,689,475 (Kleiner et al.); 4,800,253 (Kleiner et al.); and, 4,924,074 (Fang et al.). The disclosure of each of these U.S. Patents is hereby incorporated herein by reference.

Figure 5:
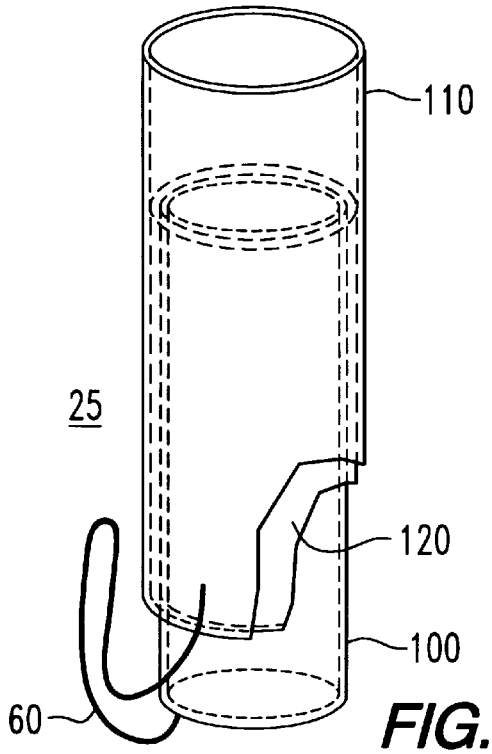
FIG. 5 is a perspective view of a single layer current limiting polymer element.

Generally speaking, the larger the contact area between the current limiting polymer material and the electrodes attached thereto the lower the contact resistance of the current limiting polymer element and, consequently, the lower the overall resistance of the fuse. Thus, to provide a low resistance fuse, the contact area between the current limiting polymer material and the electrodes attached thereto should be large. Also, the geometry of the current limiting polymer element should preferably allow for incorporation into a compact fuse. A cylindrical geometry provides both a large contact area and a compact size relative to various alternative geometries. FIG. 5 shows a perspective view of a preferred single layer current limiting polymer element of cylindrical geometry comprising a single layer of current limiting polymer material 120 rolled into a cylinder interposed between an inner electrode 100 and an outer electrode 110. Preferably, the inner electrode is in contact with substantially the entire inner surface area of the cylinder of current limiting polymer material and extends beyond the current limiting polymer material on one end of the cylinder. Likewise, the outer electrode preferably is in contact with substantially the entire outer surface area of the cylinder of current limiting polymer material and extends beyond the current limiting polymer material on one end of the cylinder. Most preferably, the inner electrode and the outer electrode extend beyond the current limiting polymer material on opposing ends of the cylinder as shown in FIG. 5.

The current limiting polymer element may comprise a multiplicity of individual component elements electrically coupled together. For example, these components may be cylinders of current limiting polymer material of decreasing diameters. Alternatively, the component elements may be plates sandwiched together.

It should be noted that multi-layers of current limiting polymer material may pose a heat conduction problem. Particularly, the resistivity of the current limiting polymer material is a function of temperature as well as electric field. Hot spots in a current limiting polymer material generate electric fields high enough to cause voltage breakdown and arcing. This arcing should be minimized or completely eliminated to facilitate reliable fuse operation. In the preferred embodiment of the invention incorporating a rolled current limiting polymer element, the central section of the element may experience higher temperatures than the rest of the element under steady state conditions. Accordingly, to alleviate the concerns with hot spots and arcing, a current limiting polymer material with a transition temperature in the range of 130–230° C. should be used such that only high fault currents will produce sufficient heat generation to cause a transition.

The size of the current limiting polymer element used will depend on the desired rating of the fuse. In general, the lower the current rating of the fuse, the smaller the size of the current limiting polymer element needed. The required size of the current limiting polymer element for a given application is determined by the joule heating ($I^2R$) necessary to cause the current limiting polymer material to transition to its high resistance state. The current limiting polymer element should be sized such that the device temperature will be below the transition temperature of the current limiting polymer material under the rated current conditions for the fuse. The device resistance and the resistivity of the current limiting polymer element is determined by the cross-sectional area of the current limiting polymer material. The device resistance and the resistivity of the current limiting polymer element is also determined by the specific current limiting polymer material used. One skilled in the art would know to select the appropriate current limiting polymer material and cross-sectional area to provide the desired device resistance and resistivity.

Preferably, the fuse further comprises a shunt 60 connected in parallel with current limiting polymer element 25 and designed to prevent overvoltage on the current limiting polymer element during switching under fault current conditions and to absorb inductively stored energy. The shunt preferably comprises an iron wire or a sheet consisting of stainless steel shim stock or a similar metal of suitable resistivity and has a resistance rating in the range of 0.05Ω to 10Ω, most preferably 0.1Ω.

The means for biassing the moving contact to engage the stationary contact under normal steady-state current conditions preferably comprises a contact spring 45 which is interposed between the bullet conductor 35 and a spring stop 55 located in the interior cavity of the casing.

Contact spring 55 is sized appropriately depending on the fuse rating. The flow of short circuit current through the contacts generates a magnetic field. As the flow of current through the contacts increases, so too will the magnitude of the self-induced magnetic field. As the current increases the contact withstand point will eventually be reached i.e., the point at which the strength of the Lorentz force exceeds the spring force, causing the two contacts to separate. Once the contacts separate they will draw an arc within the arc chamber 65. Such an arc will generate gas pressure in the arc chamber creating an additional force moving the bullet conductor with its moving contact away from the stationary contact. Once the arc dissipates, the contact spring will force the bullet conductor with the moving contact back to a closed position wherein the moving contact is in physical and electrical engagement with the stationary contact. Generally speaking, the stronger the spring the higher the current rating for the fuse. Preferably, the spring will be sized such that the withhold strength of the fuse will be approximately ten times the current rating of said fuse.

The interstice between and around the moving contact and the stationary contact within the interior cavity when the fuse is in an open position defines an arc chamber 65. Casing 15 preferably contains at least two vents 90 that penetrate through the casing and open onto the interior cavity. The vents are located such that their openings onto the interior cavity are blocked by the bullet conductor when the fuse is in a closed position but which are unimpeded by the bullet conductor when the fuse is in an open position. These vents are located and sized to control the magnitude of the gas pressure generated by an arc formed in the arc chamber. The further the bullet conductor 35 must move before it no longer obstructs the vents, the faster the contacts will "blow-open" in the event of an arc. The material strength of the casing will place a limit on the maximum pressure allowable in the arc chamber during an arc. Accordingly, the number, size and location of the vents employed will depend both on the desired interruption rating and on the material strength of the fuse casing and the attachments of the terminals to the casing. The opening of the contacts should work in coordination with the transition of the current limiting polymer. Sizing the contact spring to the transition temperature is necessary to insure interruption of the current. The tolerance between the bullet conductor and the interior wall of the casing also affects the opening velocity of the fuse. Preferably, the tolerance should be kept small to minimize the magnitude of the blow-by gases. The tolerance, however, should be large enough to accommodate manufacturing tolerances and the build up of debris during use. Preferably, a teflon sleeve 38 may be interposed between the interior wall of the casing and the bullet conductor. Said teflon sleeve will reduce the friction between the interior wall and the bullet conductor, thereby facilitating higher opening velocities.

Figure 6:
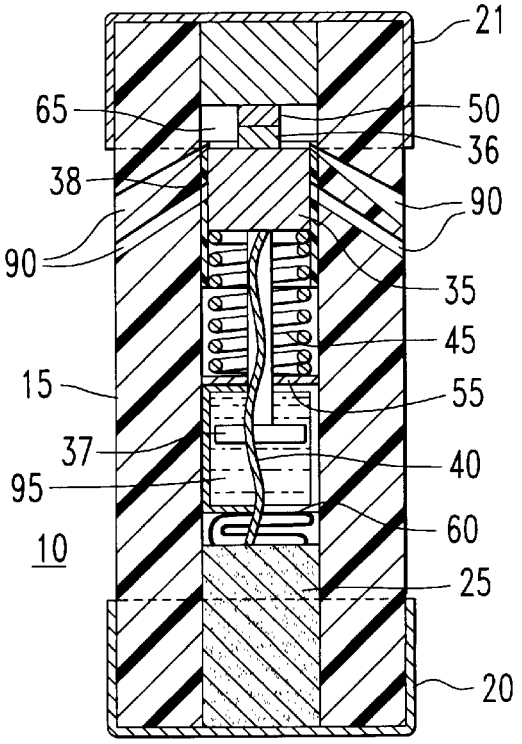
FIG. 6 is a cross sectional view of one embodiment of the resettable low voltage current limiting fuse of the invention having a means for delaying the reclosing of the fuse subsequent to removal of a fault condition.

FIG. 6 shows a diagrammatic view of a resettable low voltage current limiting fuse 10 with a reset delay in a closed position, comprising: a casing 15 with an interior cavity and a first and a second electrically conductive terminals or ferrules 20, 21; a current limiting polymer element 25 disposed within the interior cavity and in electrical contact with said first electrically conductive terminal 20; a bullet conductor 35 having a moving contact 36 slidably disposed within the interior cavity; a conductor 40 electrically connecting the current limiting polymer element to the bullet conductor; a means for delaying the resetting of the fuse following a fault condition; a stationary contact 50 within the interior cavity and in electrical contact with second electrically conductive terminal 21; and, a means for biassing the moving contact to engage the stationary contact under normal steady-state current conditions, said means shown in FIG. 6 in preferred embodiment comprising a contact spring 45 operationally interposed between the bullet conductor and a spring stop 55 located in the interior cavity.

The means for delaying the resetting of the fuse preferably comprises a fluid filled dashpot 95 disposed within the interior cavity between the bullet conductor and the current limiting polymer element and a piston 37 with a first end and a second end, wherein said first end is connected to the bullet conductor and said second end is disposed within the fluid filled dashpot. Dashpot 95 is designed to delay the reclosure of the fuse following a momentary fault condition, i.e., a fault condition where the fault is removed within seconds or less after the current has cleared. Specifically, dashpot 95 is designed to provide negligible resistance to the movement of the plunger from a closed to an open fuse position. Dashpot 95, however, is designed to provide resistance to the movement of the plunger from the open to a closed fuse position, such that the fuse will exhibit a delay in resetting. Particularly, dashpot 95 is designed to delay the resetting of the fuse following a fault current or overload current occurrence. This delay will allow time for the fault condition to clear prior to reclosure. In certain applications where fault conditions may require time to clear, dashpot 95 may be employed to prevent overheating of the current limiting polymer element resulting from repeated cycling of the fuse from an open to a closed position. Some examples of such momentary fault conditions would include a locked rotor on a motor, shipboard Navy applications, and loads which blow clear.

Figure 7:
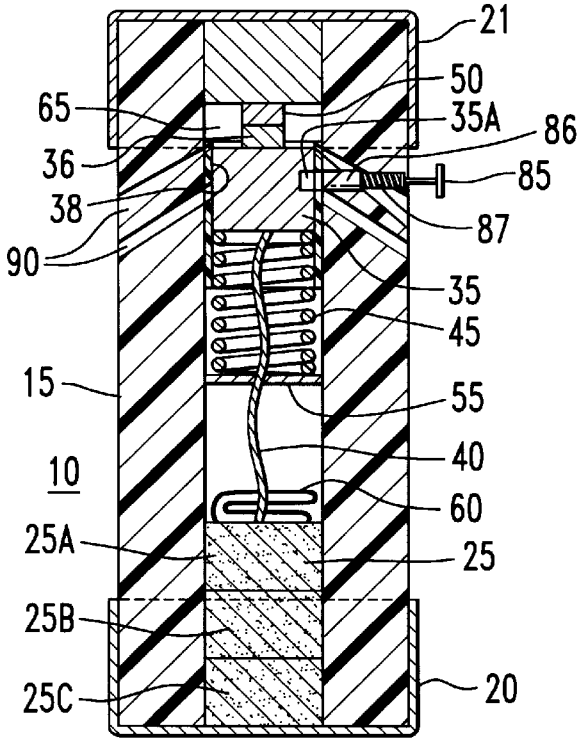
FIG. 7 is a cross sectional view of one embodiment of the resettable low voltage current limiting fuse of the invention having a means for preventing the fuse from automatically resetting subsequent to removal of a fault condition.

FIG. 7 shows a diagrammatic view of an alternative embodiment of the resettable low voltage current limiting fuse 10 of the invention wherein the fuse does not automatically reset itself following a fault condition, comprising: a casing 15 with an interior cavity and a first and a second electrically conductive terminals or ferrules 20, 21; a current limiting polymer element 25 disposed within the interior cavity and in electrical contact with said first electrically conductive terminal 20; a bullet conductor 35 having a moving contact 36 slidably disposed within the interior cavity; a conductor 40 electrically connecting the current limiting polymer element to the bullet conductor; a stationary contact 50 within the interior cavity and in electrical contact with second electrically conductive terminal 21; a means for preventing fuse 10 from automatically resetting; and, a means for biassing the moving contact to engage the stationary contact under normal steady-state current conditions, said means for biasing the moving contact shown in FIG. 7 in preferred embodiment comprising a contact spring 45 operationally interposed between the bullet conductor and a spring stop 55 located in the interior cavity.

The embodiment shown in FIG. 7 could be employed in applications where fault conditions will not clear themselves and where the line must be disconnected from the load for a long period of time.

Preferably the means for preventing fuse 10 from automatically resetting comprises a manual reset 85 having a latch pin 86 and a latch spring 87. The manual reset 85 is incorporated into the casing. Latch pin 86 is biased by spring 87 to move into the interior cavity. The movement of latch pin 86 into the interior cavity is impeded by the bullet conductor when the fuse is in the closed position with the stationary contact and the moving contact in physical and electrical engagement. When the bullet conductor is compelled by the force created by an arc in arc chamber 65 to slide away from the stationary contact, latch pin 86 is free to extend into the interior cavity. In the extended position, latch pin 86 extends into the interior cavity into the path of bullet conductor 35 thus preventing movement of the bullet conductor back into engagement with stationary contact 50. Alternatively, the latch pin may extend into engagement with a bore, depression or groove 35A in the surface of the bullet conductor. The fuse therefore will not be able to close until manual reset 85 is manually withdrawn from the interior cavity and out of the path of, or engagement with, bullet conductor 35. Once manual reset 85 is withdrawn, bullet conductor 35 can move back into engagement with stationary contact 50, closing fuse 10. In one embodiment of the invention current limiting polymer element 25 may comprise a plurality of electrically coupled layers of current limiting polymer material 25A, 25B and 25C.

Figure 8:
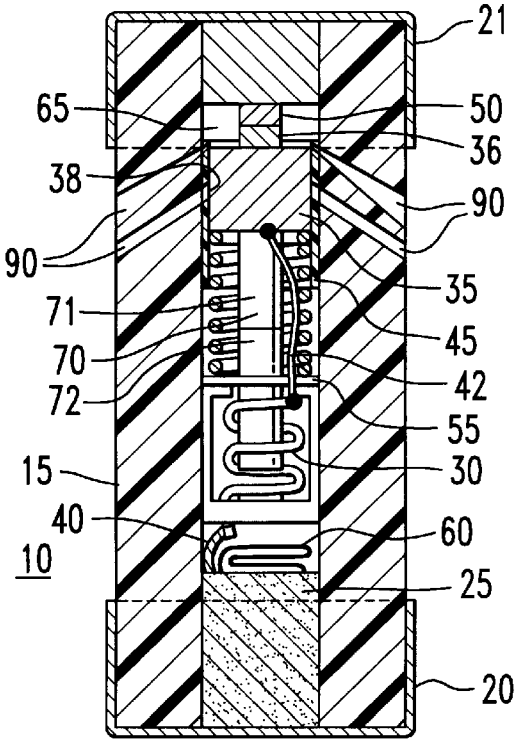
FIG. 8 is a cross sectional view of one embodiment of the resettable low voltage current limiting fuse of the invention having a solenoid to facilitate quick opening of the fuse under fault conditions.

FIG. 8 shows a diagrammatic view of an alternative embodiment of the resettable low voltage current limiting fuse 10 which is quick opening, comprising: a casing 15 with an interior cavity and a first and a second electrically conductive terminals or ferrules 20, 21; a current limiting polymer element 25 disposed within the interior cavity and in electrical contact with first electrically conductive terminal 20; a bullet conductor 35 having a moving contact 36 slidably disposed within the interior cavity; a solenoid 30 disposed between current limiting polymer element 25 and bullet conductor 35, the solenoid in electrical contact with the current limiting polymer element; a plunger 70 having an electrically insulating end 71 and a steel end 72, the insulating end connected to bullet conductor 35 with the steel end spaced apart from the bullet conductor, the steel end of the plunger disposed within the coil axis of the solenoid; a conductor 42 electrically connecting the solenoid to the bullet conductor; a stationary contact 50 within the interior cavity and in electrical contact with the second electrically conductive terminal 21; and, a means for biassing the moving contact to engage the stationary contact under normal steady-state current conditions, said means shown in FIG. 8 in preferred embodiment comprising a contact spring 45 operationally interposed between the bullet conductor and a spring stop 55 located in the interior cavity.

Solenoid 30 consists of a cylindrical coil of insulated wire which produces an axial magnetic field when current passes through the coil. Particularly, solenoid 30 produces an axial magnetic field which imparts an attractive force on plunger 70 when current passes through solenoid 30. The strength of the axial magnetic field, and consequently, the force created thereby is proportional to the square of the current flow passing through solenoid 30. Hence, the force will increase as the flow of current through solenoid 30 increases. Solenoid 30 is sized in conjunction with means 45 to accommodate the fuse rating. The use of solenoid 30 increases the contact opening speed. In addition to increasing the contact opening speed, incorporation of a solenoid in the fuse also provides for effective use of the fuse in lower fault current applications. Specifically, if the fault current is in the range of 70 $A_{rms}$ to 500 $A_{rms}$, sufficient gas pressure from arcing may not be generated to blow-open the contacts. The solenoid can effectively be employed to effect operation of the fuse in this current range. The solenoid is connected in electrical series between the contacts and the current limiting polymer element.

Conductor 42 is identical to conductor 40 discussed previously with the exception that conductor 42 provides an electrical coupling of solenoid 70 and bullet conductor 35. Contrastingly, conductor 40 provides an electrical coupling of conductive polymer element 25 and bullet conductor 30. Notwithstanding, conductor 42 preferably comprises a flexible wire or braids, or a multiplicity of flexible wires or braids.

Figure 9:
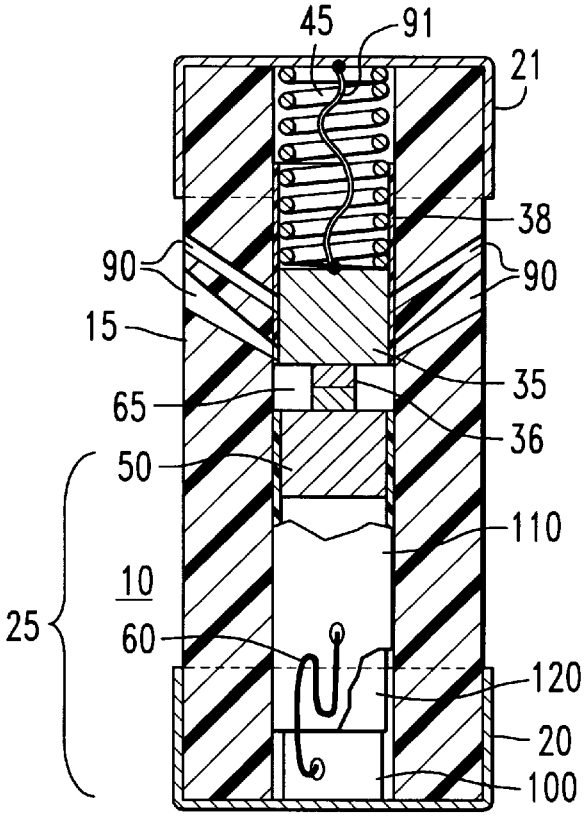
FIG. 9 is a cross sectional view of one embodiment of the resettable low voltage current limiting fuse of the invention that automatically resets itself following removal of a fault condition.

FIG. 9 shows a diagrammatic view of another alternative embodiment of a resettable low voltage current limiting fuse 10 in a closed position comprising: a casing 15 with an interior cavity and a first and a second electrically conductive terminals or ferrules 20, 21; a current limiting polymer element 25 disposed within the interior cavity and in electrical contact with said first electrically conductive terminal 20; a stationary contact 50 within the interior cavity and in electrical contact with said current limiting polymer element; a bullet conductor 35 having a moving contact 36 slidably disposed within the interior cavity; an optional conductor 91 electrically connecting said bullet conductor to said second electrically conductive terminal 21; and a means for biassing the moving contact to engage the stationary contact 36 under normal steady-state current conditions, said means shown in FIG. 9 in preferred embodiment comprising a contact spring 45 operationally interposed between the bullet conductor and the second electrically conductive terminal.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

We claim:

1. A reseftable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions; and a spring stop disposed within said interior cavity and spaced apart from the bullet conductor such that the bullet conductor is interposed between the spring stop and the stationary contact and wherein the means for biassing the moving contact to engage the stationary contact comprises a spring disposed between said bullet conductor and said spring stop.

2. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions; and a teflon sleeve disposed between the wall of the interior cavity and the bullet conductor.

3. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions; and wherein the current limiting polymer element has a cylindrical geometry and a transition temperature of 130° to 230° C.

4. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions; and wherein the current limiting polymer element comprises a plurality of electrically coupled layers of current limiting polymer material.

5. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions; and wherein the current limiting polymer element comprises a plurality of electrically coupled, concentric cylinders of current limiting polymer materials.

6. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions;

a solenoid disposed within the interior cavity, interposed between the current limiting polymer element and the bullet conductor and in electrical contact with the current limiting polymer element;

a plunger having an electrically insulating end and a steel end with the insulating end connected to the bullet conductor and the steel end disposed within the coil axis of the solenoid; and wherein the conductor electrically connects the bullet conductor to the solenoid.

7. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions; and wherein the conductor comprises at least one wire or braid.

8. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions; and at least one of the means for delaying the resetting of said fuse following a fault condition and a means for preventing said fuse from automatically resetting subsequent to a fault condition disposed within said casing.

9. The resettable low voltage current limiting fuse of claim 8 wherein the means for delaying the resetting of the fuse following a fault condition comprises:

a dashpot; and a piston with a first end and a second end, wherein said first end is connected to the bullet conductor and said second end is operatively disposed within the dashpot.

10. The resettable low voltage current limiting fuse of claim 8 wherein the means for preventing the fuse from automatically resetting subsequent to a fault condition comprises:

a manual reset having a latch pin and a latch spring attached to said casing wherein the latch spring biases the latch pin to extend into the interior cavity, and wherein the latch pin is impeded from extending into the interior cavity under normal conditions by the bullet conductor, but wherein displacement of the bullet conductor under fault conditions allows the latch pin to extend into the interior cavity preventing the bullet conductor from moving back into engagement with the stationary contact.

11. The resettable low voltage current limiting fuse of claim 10 wherein the bullet conductor has a bore and wherein the latch pin extends into engagement with said bore when the bullet conductor is displaced under fault conditions.

12. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions; and a shunt located within the interior cavity and connected in electrical parallel with the current limiting polymer elements.

13. The resettable low voltage current limiting fuse of claim 12 wherein the shunt has a resistance of 0.05Ω to 10Ω.

14. The resettable low voltage current limiting fuse of claim 12 wherein the shunt comprises an iron wire.

15. The resettable low voltage current limiting fuse of claim 12 wherein the shunt has a resistance of 0.1Ω.

16. A resettable low voltage current limiting fuse comprising:

a casing having an interior cavity and a first and a second electrically conductive terminals;

a current limiting polymer element disposed within said interior cavity and in electrical contact with said first electrically conductive terminal;

a bullet conductor having a moving contact slidably disposed within said interior cavity;

a conductor electrically connecting said current limiting polymer element to said bullet conductor;

a stationary contact within said interior cavity and in electrical contact with said second electrically conductive terminal;

a means for biassing the moving contact to engage the stationary contact under normal steady-state current conditions;

an arc chamber formed within the interior cavity in the interstice between and around the moving contact and the stationary contact; and at least two vents penetrating through the casing into the interior cavity, said at least two vents opening onto the arc chamber such that said at least two vents are blocked by the bullet conductor when the fuse is in a closed position.

17. A resettable low voltage current limiting fuse comprising:

a casing having an interior cavity and a first and a second electrically conductive terminals;

a current limiting polymer element disposed within said interior cavity and in electrical contact with said first electrically conductive terminal;

a stationary contact within said interior cavity and in electrical contact with said current limiting polymer element;

a bullet conductor having a moving contact slidably disposed within said interior cavity;

a means for biassing the moving contact to engage the stationary contact under normal steady-state current conditions; and wherein the current limiting polymer element has a transition temperature of 130° to 230° C.

18. A resettable low voltage current limiting fuse comprising:

a casing having an interior cavity and a first and a second electrically conductive terminals;

a current limiting polymer element disposed within said interior cavity and in electrical contact with said first electrically conductive terminal;

a stationary contact within said interior cavity and in electrical contact with said current limiting polymer element;

a bullet conductor having a moving contact slidably disposed within said interior cavity;

a means for biassing the moving contact to engage the stationary contact under normal steady-state current conditions; and wherein the current limiting polymer element comprises a plurality of layers of electrically coupled layers of current limiting polymer material.

19. A resettable low voltage current limiting fuse comprising:

a casing having an interior cavity and a first and a second electrically conductive terminals;

a current limiting polymer element disposed within said interior cavity and in electrical contact with said first electrically conductive terminal;

a stationary contact within said interior cavity and in electrical contact with said current limiting polymer element;

a bullet conductor having a moving contact slidably disposed within said interior cavity;

a means for biassing the moving contact to engage the stationary contact under normal steady-state current conditions; and wherein the current limiting polymer element comprises a plurality of electrically coupled concentric cylinders of current limiting polymer materials.

20. A reseftable low voltage current limiting fuse comprising:

a casing having an interior cavity and a first and a second electrically conductive terminals;

a current limiting polymer element disposed within said interior cavity and in electrical contact with said first electrically conductive terminal;

a stationary contact within said interior cavity and in electrical contact with said current limiting polymer element;

a bullet conductor having a moving contact slidably disposed within said interior cavity;

a means for biassing the moving contact to engage the stationary contact under normal steady-state current conditions;

a solenoid, electrically connected to the second electrically conductive terminal and disposed within the interior cavity interposed between the means for biassing the moving contact to engage the stationary contact and the second electrically conductive terminal;

a plunger having an electrically insulating end and a steel end with the insulating end connected to the bullet conductor and the steel end disposed within the coil axis of the solenoid; and a conductor electrically connecting the bullet conductor to the solenoid.

21. The resettable low voltage current limiting fuse of claim 8 wherein the conductor comprises at least one wire or braid.

22. A resettable low voltage current limiting fuse comprising:

a casing having an interior cavity and a first and a second electrically conductive terminals;

a current limiting polymer element disposed within said interior cavity and in electrical contact with said first electrically conductive terminal;

a stationary contact within said interior cavity and in electrical contact with said current limiting polymer element;

a bullet conductor having a moving contact slidably disposed within said interior cavity;

a means for biassing the moving contact to engage the stationary contact under normal steady-state current conditions; and at least one of a means for delaying the resetting of said fuse following a fault condition; and at least one of a means for delaying the resetting of said fuse following a fault condition and a means for preventing said fuse from automatically resetting subsequent to a fault condition disposed within said casing.

23. The resettable low voltage current limiting fuse of claim 22 wherein the means for delaying the resetting of the fuse following a fault condition comprises:

a dashpot; and a piston with a first end and a second end, wherein said first end is connected to the bullet conductor and said second end is operatively disposed within the dashpot.

24. The resettable low voltage current limiting fuse of claim 22 wherein the means for preventing the fuse from automatically resetting subsequent to a fault condition, comprises:

a manual reset having a latch pin and a spring attached to said casing wherein the latch spring biases the latch pin to extend into the interior cavity, and wherein the latch pin is impeded from extending into the interior cavity under normal conditions by the bullet conductor, but wherein displacement of the bullet conductor under fault conditions allows the latch pin to extend into the interior cavity preventing the bullet conductor from moving back into engagement with the stationary contact.

25. The resettable low voltage current limiting fuse of claim 24 wherein the bullet conductor has a bore and wherein the latch pin extends into engagement with said bore when the bullet conductor is displaced under fault conditions.

26. The resettable low voltage current limiting fuse of claim 22 wherein the shunt has a resistance of 0.05Ω to 10Ω.

27. The resettable low voltage current limiting fuse of claim 22 wherein the shunt comprises an iron wire.

28. The resettable low voltage current limiting fuse of claim 22 wherein the shunt has a resistance of 0.1Ω.

29. A resettable low voltage current limiting fuse comprising:

a casing having an interior cavity and a first and a second electrically conductive terminals;

a current limiting polymer element disposed within said interior cavity and in electrical contact with said first electrically conductive terminal;

a stationary contact within said interior cavity and in electrical contact with said current limiting polymer element;

a bullet conductor having a moving contact slidably disposed within said interior cavity;

a means for biassing the moving contact to engage the stationary contact under normal steady-state current conditions; and a shunt located within the interior cavity and connected in electrical parallel with the current limiting polymer elements.

30. A resettable low voltage current limiting fuse comprising:

a casing having an interior cavity and a first and a second electrically conductive terminals;

a current limiting polymer element disposed within said interior cavity and in electrical contact with said first electrically conductive terminal;

a stationary contact within said interior cavity and in electrical contact with said current limiting polymer element;

a bullet conductor having a moving contact slidably disposed within said interior cavity;

a means for biassing the moving contact to engage the stationary contact under normal steady-state current conditions; and an arc chamber formed within the interior cavity in the interstice between and around the moving contact and the stationary contact; and at least two vents penetrating through the casing into the interior cavity, said at least two vents opening onto the arc chamber such that said at least two vents are blocked by the bullet conductor when the fuse is in a closed position.

* * * * *